US005738082A

United States Patent [19]

Page et al.

[11] Patent Number: 5,738,082

[45] Date of Patent: Apr. 14, 1998

[54] PORTABLE BABY WIPES WARMER AND CARRIER

[76] Inventors: Glenn A. Page; Marie L. Page, both of 4738 Anaconda Rd., Bensalem, Pa. 19020

[21] Appl. No.: 503,982

[22] Filed: Jul. 19, 1995

[51] Int. Cl.[6] ..... F24J 1/00

[52] U.S. Cl. ..... 126/263.01; 126/263.05; 126/263.07

[58] Field of Search ..... 126/263.01, 263.02, 126/263.07, 263.1, 204, 262

[56] References Cited

U.S. PATENT DOCUMENTS

| | | | |
|---|---|---|---|
| 1,659,185 | 2/1928 | Baker | 126/263.02 |
| 2,220,777 | 11/1940 | Othmer | 126/263.04 |
| 2,733,709 | 2/1956 | Sukacev | 126/263.06 X |
| 2,844,141 | 7/1958 | Daugherty | 126/263.05 |
| 3,658,122 | 4/1972 | Kalyk | 165/1 |
| 3,683,889 | 8/1972 | Hoffman | 126/263.07 |
| 3,805,018 | 4/1974 | Luong et al. | 219/387 |
| 4,043,314 | 8/1977 | Trumble et al. | 126/263.01 |
| 4,390,551 | 6/1983 | Swartley | 426/107 |
| 4,510,919 | 4/1985 | Benmussa | 126/263.08 |
| 4,777,931 | 10/1988 | Ziegler et al. | 126/246 |
| 4,810,859 | 3/1989 | Anabtawi et al. | 219/535 |
| 4,943,705 | 7/1990 | Halloran | 219/385 |
| 5,210,396 | 5/1993 | Sanders | 219/521 |
| 5,295,475 | 3/1994 | Kaneko | 126/262 X |

*Primary Examiner*—Larry Jones
*Attorney, Agent, or Firm*—Susan Borden Evans

[57] ABSTRACT

Disclosed herein is a portable baby wipes warmer and carrier comprising a container with a plurality of compartments including minimally a heating unit storage compartment, a baby wipes storage compartment and a means for carrying the container. The invention utilizes a portable heating unit positioned within a heating unit storage compartment to warm the subject baby wipes and maintain the warmth of the baby wipes for a substantial period of time.

13 Claims, 2 Drawing Sheets

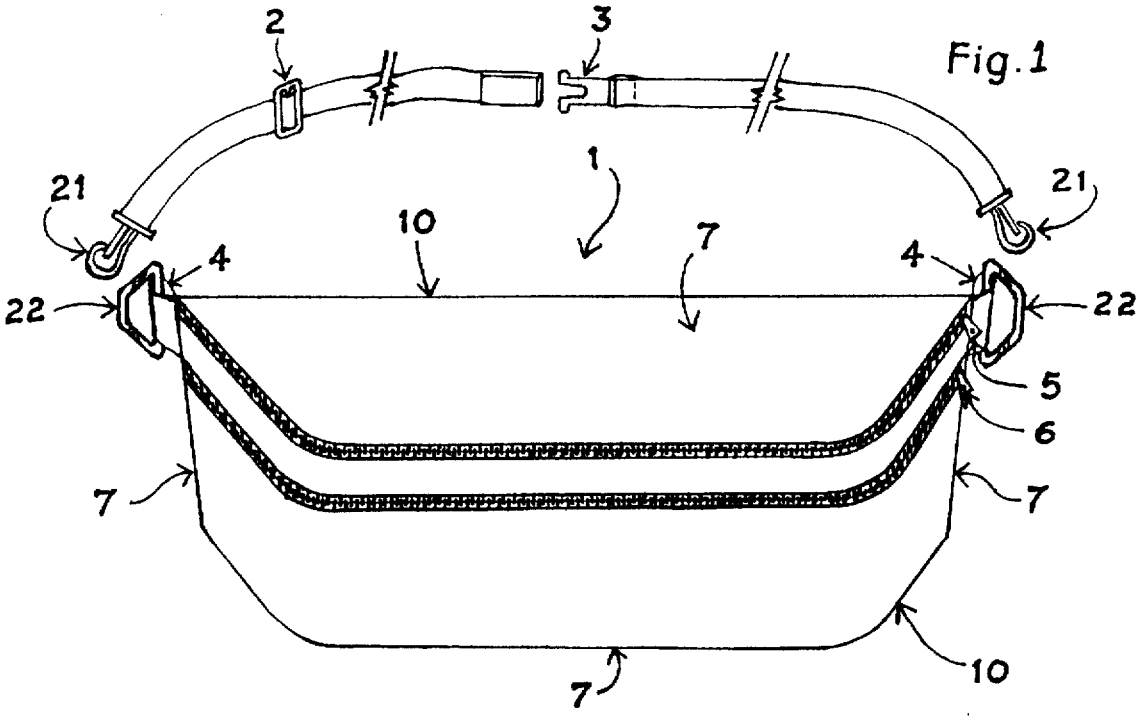
Fig.1
Fig.2
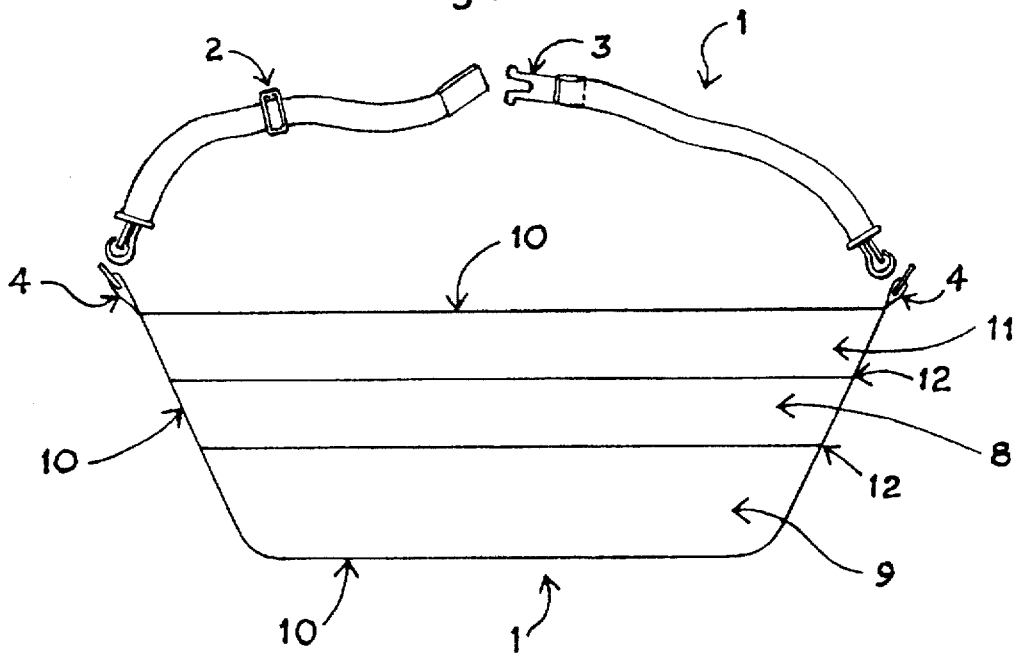

PORTABLE BABY WIPES WARMER AND CARRIER

The present invention relates to a portable warmer and carrier for baby wipes.

BACKGROUND

Baby wipes also referred to as wet baby cloths are towel like handiwipes used to wash infants. Baby wipes have become increasingly popular in use with parents or caretakers on the go. Baby wipes or wet baby cloths are generally cold and wet. They are primarily used in sensitive areas on babies. This often causes discomfort to the infant and makes certain routine cleanup tasks difficult and tedious.

Prior to the present invention, baby wipes were carried in baby bags along with other baby clothing and bottles and other items that may be needed for caring for a baby on the go. Since baby wipes contain a cream and/or water based fluid for cleaning the baby, these baby wipes would be uncomfortable to the baby's delicate skin especially in cold weather. Prior to the present invention, no prior art was found that addressed the tender nature of the baby's skin and the provision of a heating device for heating the baby wipes to body temperature or a temperature that would be comfortable to the baby, as well as making the baby wipes completely portable so that active parents or caretakers who want to take baby along can do so with a minimal of paraphernalia.

A brochure from the company One Step Ahead advertises a "Keep Wipes Cozy Warm and Watch Your Baby Smile" device that is a heating wrap for keeping the wipes at a temperature of 99° C., that wraps around containers of wipes and plugs into a household outlet or possibly a cigarette lighter in an automobile. This device is similar to a bottle warmer that has been used for many years by people taking babies on trips.

U.S. Pat. No. 3,805,018 discloses a portable carrying case for carrying food and food warmer apparatus. This carrying case is rectangular in shape and looks like a brief case or a lunch pail and is made of rigid material; this case is bulky and heavy and not suitable for sports enthusiasts that may need both hands for performing his/her life style.

U.S. Pat. No. 4,777,931 discloses a plate warmer and lid for warming food at a remote location from where the food is prepared.

None of the prior art discloses the instant invention.

SUMMARY OF THE INVENTION

The present invention relates to a portable baby wipes warmer and carrier comprising a container made of a soft fabric material that has at least two compartments with a common heat conducting wall between and a means for carrying the container, a portable heating unit that is stored in one of the compartments, and baby wipes that are stored in the other compartment wherein the heating unit is so positioned in heat conveying proximity so that heat is conveyed through the common wall of the compartments so that the baby wipes are heated and kept warm for a substantial period of time. A further embodiment of the present invention provides a carrier formed as a waist pouch. The waist pouch is easily stored or hung in a place convenient for its use. A still further embodiment of this invention provides for a preformed foldable disc with optional fastener means which provides a cover for a portable heating unit suitable for warming baby wipes.

BRIEF DESCRIPTION OF THE DRAWINGS

These as well as other features of the present invention will become more apparent upon reference to the drawings wherein:

FIG. 1 is a perspective view of the exterior of the carrier of the present invention when said carrier is in a closed position for carrying by an individual;

FIG. 2 is a cross section of the portable baby wipes warmer and carrier of the invention;

DETAILED DESCRIPTION OF THE INVENTION

Figure 3:
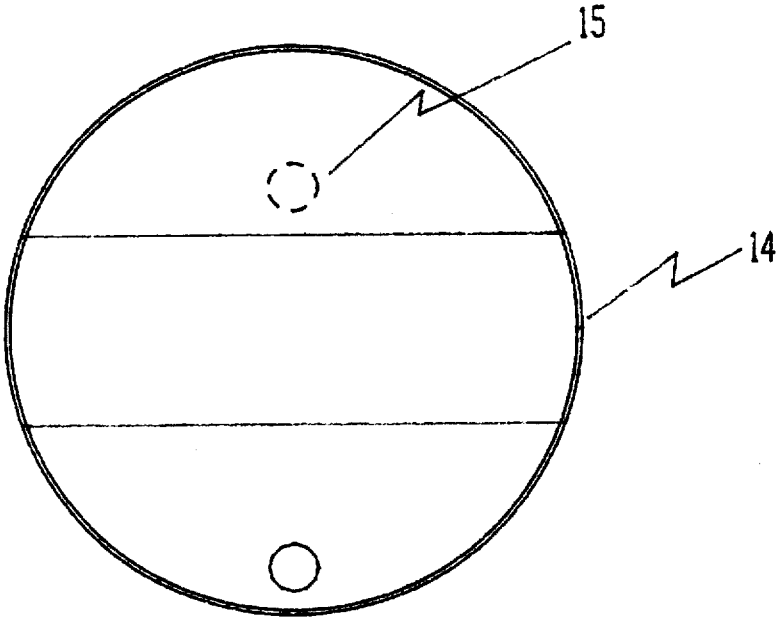
FIG. 3 is an isolated top view of a heat disc of the invention.

Referring to the drawings, FIGS. 1–4 illustrate a portable warmer and carrier for baby wipes referred to by the general reference character 1, for carrying baby wipes and other baby articles which are enhanced by warmth, such as baby bottles 9.

FIG. 1 illustrates the baby wipes warmer and carrier 1, hereinafter "Carrier", as it appears from the exterior when closed and arranged for carrying by an individual. Carrier 1 has exterior walls 10 which define its exterior shape, which include a top (cover), and side portions 7, as well as a bottom portion not in view, and optional side belt fastener loop 4. The side belt fastener loop 4 is attached to a hook 22 which in turn is suitable for attachment to lobster claw hook 21 which forms the attachment means of adjustable strap 2. The exterior walls 10 are preferably comprised of a heat resistant or insulating material such as rubberized fabrics, plastic (soft), plastic (molded), cloth fabric, cloth fabric with plastic backing; or heat retaining materials such as thermo plastic; preferably rubberized fabric. Zippers 5 and 6 provide opening and closing means of access to separate compartments as defined in the present invention. Carrier 1 in a preferred embodiment is a pouch and is provided with a detachable, adjustable strap 2 with a belt clip 3 suitable for wearing around the waist. The detachable, adjustable strap 2 has attachment means herein exemplified as lobster claw hook 21, but may also be any other suitable attachment means. A further embodiment utilizes the strap as a shoulder strap. Other embodiments of a carrier include baby wipes box made of plastic, and various similar warming containers.

FIG. 2 illustrates, interior separator walls 12 which in conjunction with the exterior walls 10 define a plurality of compartments including minimally a baby wipes storage compartment 11 and a heating unit storage compartment 8. Other general purpose compartments 9, such as the baby bottle storage compartment 9 are optional. The baby wipes storage compartment 11 and a baby bottle storage compartment 9 both have walls adjacent to heating unit storage compartment 8 interior separator walls 12 to permit heat to be conveyed from the heating unit storage compartment 8 to the baby wipes storage compartment 11. Interior separator walls 12 are preferably comprised of a heat permeable material such as perforated nylon (netted), plastic film, perforated plastic and fabric; preferably perforated nylon (netted). Compartments 8, 9 and 11 may be accessed from the exterior walls 10 of said Carrier by zippers 5 and 6 (see FIG. 1).

FIG. 3 illustrates an optional heat disc of the present invention. A preformed foldable heat disc 14 with optional fastener means 15 is shaped to fold into a predetermined size which fits within the heating unit storage compartment. The portable heating unit of the present invention is optionally insertable into the heat disc in the folded or unfolded embodiment. Further the portable heating unit may be utilized directly without the heat disc described herein. The portable heating unit of the present invention keeps the baby wipes warm for a period greater than 2 hours, preferably from 2 to 4 hours, more preferably from 2 to 6 hours and include microwavable gel pack, exothermic gel boil pack and dry heat organic oxidation pack; preferably a microwavable gel pack or exothermic gel boil pack; most preferably a microwavable gel pack. Examples of the microwavable gel pack and exothermic gel boil pack include Heat Comfort™ manufactured by 3M Personal Care Products, St. Paul, Minn. 55144 and Champ® manufactured by Hot Wrap Carolon Co., Rural Hall, N.C. An example of the exothermic dry heat organic oxidation pack is HotHands™ by Heatmax, Inc., PO Box 1191, Dalton, Ga. (1-800-432-8629).

Figure 4:
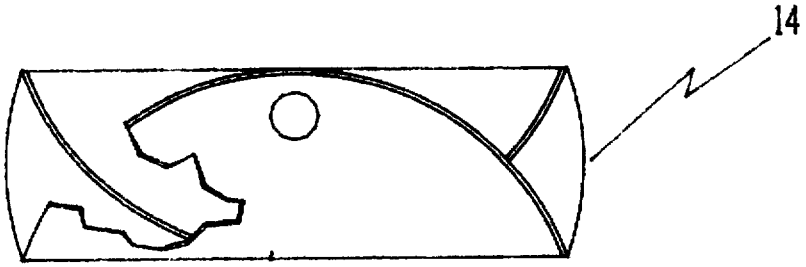
FIG. 4 is an isolated top view of a folded heat disc of the invention.

FIG. 4 illustrates an isolated top view of a folded heat disc 14, which is an optional embodiment of the instant invention. The heat disc 14 is folded over a portable heating unit such as a microwavable gel pack. The heat disc is secured by means of a Velcro tab 15 (see FIG. 3) or other suitable fastener means including but not limited to snaps and ties. In the folded embodiment the heat disc 14 slides into the heating unit storage compartment. The heat disc 14 may also be inserted into a compartment containing baby wipes or suitably positioned in the lid, side or on the surface of a baby wipe container. In a further embodiment the preformed foldable disc 14 is fitted with a heat permeable interior pocket suitable for storing baby wipes and may be independently utilized for warming and transporting baby wipes.

While the invention has been herein shown and described in what is presently conceived to be the most practical and preferred embodiment thereof, it will be apparent that many changes and modifications in the specifically described embodiments may be made without departing from the scope and spirit of the invention. It is intended that the broadest interpretation be accorded to the appended claims so as to encompass all equivalent structures and devices.

What is claimed is:

1. A portable baby wipes warmer and carrier comprising a container made of a soft fabric material that has at least two compartments with a common heat conducting wall between and a means for carrying the container, a portable heating unit that is stored in one of the compartments, and baby wipes that are stored in the other compartment wherein the portable heating unit is so positioned in heat conveying proximity so that heat is conveyed through the common wall of the compartments so that the baby wipes are heated and kept warm for a substantial period of time.

2. The portable baby wipes warmer and carrier of claim 1 wherein said container has exterior walls which consist of a heat insulating material.

3. The portable baby wipes warmer and carrier of claim 2 wherein said common heat conducting wall consists of a heat permeable material.

4. The portable baby wipes warmer and carrier of claim 3 wherein said baby wipes warmer and carrier has an opening and closing means of access to each separate compartment.

5. The portable baby wipes warmer and carrier of claim 1 wherein said compartments include:

a heating unit storage compartment situated between a baby wipes storage compartment; and a baby bottle storage compartment.

6. The portable baby wipes warmer and carrier of claim 1 wherein said baby wipes stored therein remain warm for a period of from 2 to 6 hours and wherein said portable heating unit is selected from the group consisting of microwavable gel pack, exothermic gel boil pack and dry heat organic oxidation pack.

7. The portable baby wipes warmer and carrier of claim 6 wherein said baby wipes remain warm for a period of from 2 to 4 hours and wherein said portable heating unit is a microwavable gel.

8. The portable baby wipes warmer and carrier of claim 7 wherein said container is a pouch.

9. The portable baby wipes and carrier of claim 8 wherein said pouch includes a detachable adjustable strap suitable for securing the pouch around a waist of an individual.

10. The portable baby wipes warmer and carrier of claim 5 wherein said baby wipes remain warm for a period of from 2 to 6 hours and wherein said portable heating unit is selected from the group consisting of microwavable gel pack, exothermic gel boil pack and dry heat organic oxidation pack.

11. The portable baby wipes warmer and carrier of claim 10 wherein said baby wipes remain warm for a period of from 2 to 4 hours and wherein said portable heating unit is a microwavable gel.

12. The portable baby wipes warmer and carrier of claim 11 wherein said container is a pouch.

13. The portable baby wipes warmer and carrier of claim 12 wherein said pouch includes a detachable adjustable strap suitable for securing the pouch around waist of an individual.

* * * * *